United States Patent [19]

Mitchell

[11] 4,320,537

[45] Mar. 23, 1982

[54] SHOULDER PAD

[75] Inventor: Hal D. Mitchell, Rolla, Mo.

[73] Assignee: A-T-O Inc., Willoughby, Ohio

[21] Appl. No.: 143,917

[22] Filed: Apr. 25, 1980

[51] Int. Cl.[3] ..... A41D 13/00

[52] U.S. Cl. ..... 2/2

[58] Field of Search ..... 2/2, 44, 45, 267, 268

[56] References Cited

U.S. PATENT DOCUMENTS

| | | | |
|---|---|---|---|
| 2,430,502 | 11/1947 | Goldsmith | 2/2 |
| 3,146,461 | 9/1964 | Kavanagh | 2/2 |
| 3,166,760 | 1/1965 | Rasmussen | 2/2 |
| 3,740,763 | 6/1973 | Mitchell | 2/2 |
| 4,135,252 | 1/1979 | Latina et al. | 2/2 |
| 4,158,242 | 6/1979 | Mitchell | 2/2 |

*Primary Examiner*—Henry Jaudon

*Attorney, Agent, or Firm*—Senniger, Powers, Leavitt and Roedel

[57] ABSTRACT

A shoulder pad for football players comprising a left-hand member which fits over the left shoulder and a right-hand member which fits over the right shoulder. Each of the members is a relatively rigid member of generally inverted U-shape as viewed from the side and has a chestplate portion, a backplate portion and an arch integrally connecting the plate portions. Each member has padding on the inside thereof with the padding at the top of the arch overlying the shoulder. A pair of caps of relatively rigid material fit over the outer part of the shoulders and have shoulder padding on the inside thereof separate from the arch padding. The shoulder padding is hinged to the arch padding for enabling the shoulder padding to swing upwardly relative to the arch padding.

10 Claims, 5 Drawing Figures

SHOULDER PAD

BACKGROUND OF THE INVENTION

This invention relates generally to athletic apparel, and more particularly to a shoulder pad for football players which allows greater flexibility of movement.

Shoulder pads as conventionally designed have been extremely bulky and cumbersome and have limited the upper body movement of football players to a great degree, especially movement of the arms above the horizontal position. Reference may be made to coassigned U.S. Pat. No. 4,135,252 on which the present invention is an improvement.

SUMMARY OF THE INVENTION

Among the several objects of this invention may be noted the provision of an improved shoulder pad which allows greater mobility of the upper body of the wearer, particularly the shoulders, so that the arms may be raised without undue interference from the shoulder pad; the provision of such a shoulder pad which provides added protection for the shoulders of the wearer; the provision of such a shoulder pad which is compact and simple in design; and the provision of such a shoulder pad which is economical to manufacture and easy to maintain.

Generally, a shoulder pad of this invention comprises a left-hand member adapted to fit over the left shoulder and a right-hand member adapted to fit over the right shoulder, each of the members being a relatively rigid member of generally inverted U-shape as viewed from the side and having a chestplate portion, a backplate portion and an arch integrally connecting the plate portions. The arches are laterally spaced to provide an opening for the neck of the wearer with the spacing such that the arches lie relatively closely adjacent the neck. Each member has padding on the inside thereof with the padding at the top of the arch overlying the shoulder. A pair of caps of relatively rigid material are adapted to fit over the outer part of the shoulders and have shoulder padding on the inside thereof separate from the arch padding. The shoulder padding is hinged to the arch padding for enabling the shoulder padding to swing upwardly relative to the arch padding whereby freedom is provided for raising the arms above a horizontal position by permitting upward movement of the arm at the shoulder without substantial interference from the shoulder padding.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
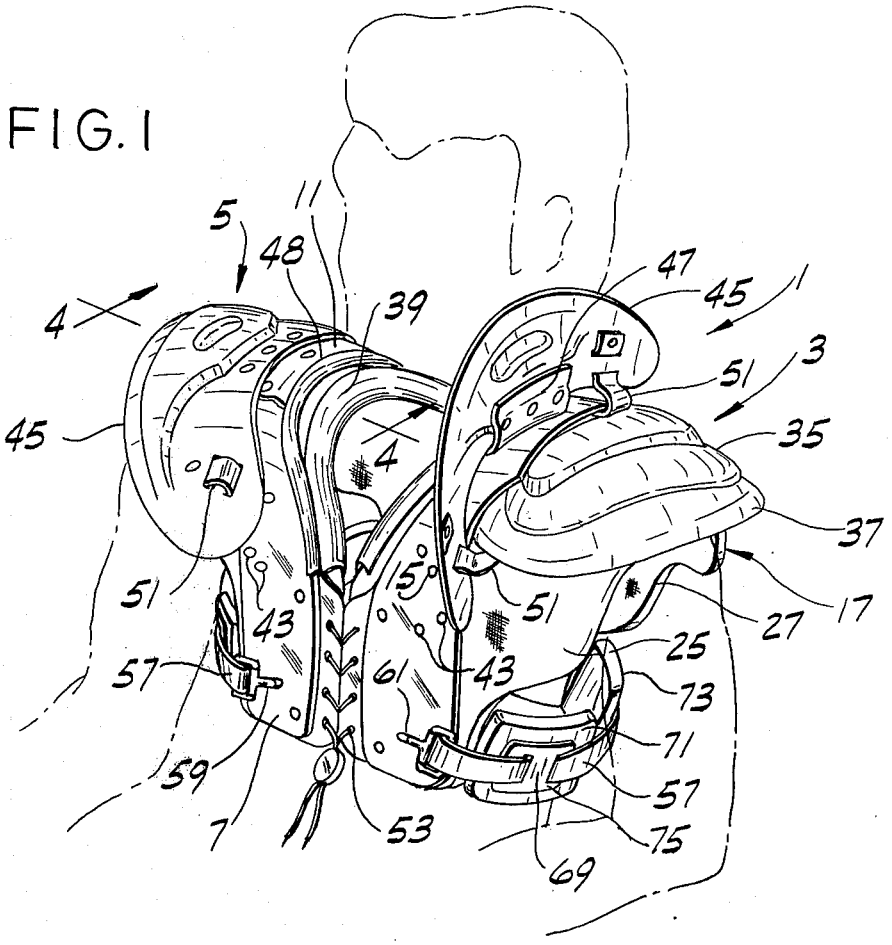
FIG. 1 is a perspective of a shoulder pad of this invention being worn by a football player, a flap of the left-hand member of the shoulder pad being raised to illustrate details.

Referring to the drawings, a shoulder pad made according to the present invention is designated generally by the numeral 1 and is shown in FIG. 1 worn by a football player. It comprises a left-hand member generally indicated at 3 which fits over the left shoulder of the player and a right-hand member generally indicated at 5 which fits over the right shoulder. These two members 3, 5 may be of a suitable relatively lightweight molded plastic material, such as a high density polyethylene having a sufficiently high impact resistance to withstand the heavy blows received during the course of a football game. Each of the members is of generally inverted U-shape as viewed from the side, comprising a chestplate portion 7, a backplate portion 9, and an arch 11 integrally connecting the plate portions 7, 9. The arches 11 of the two members 3, 5 are laterally spaced to provide an opening for the neck of the wearer, with the spacing being such that the arches lie adjacent and relatively close to the neck. A curved, relatively stiff member 13 extends as shown in FIG. 4 along the underside of the arch and is affixed by rivets 15 at its ends to the arch.

Figure 2:
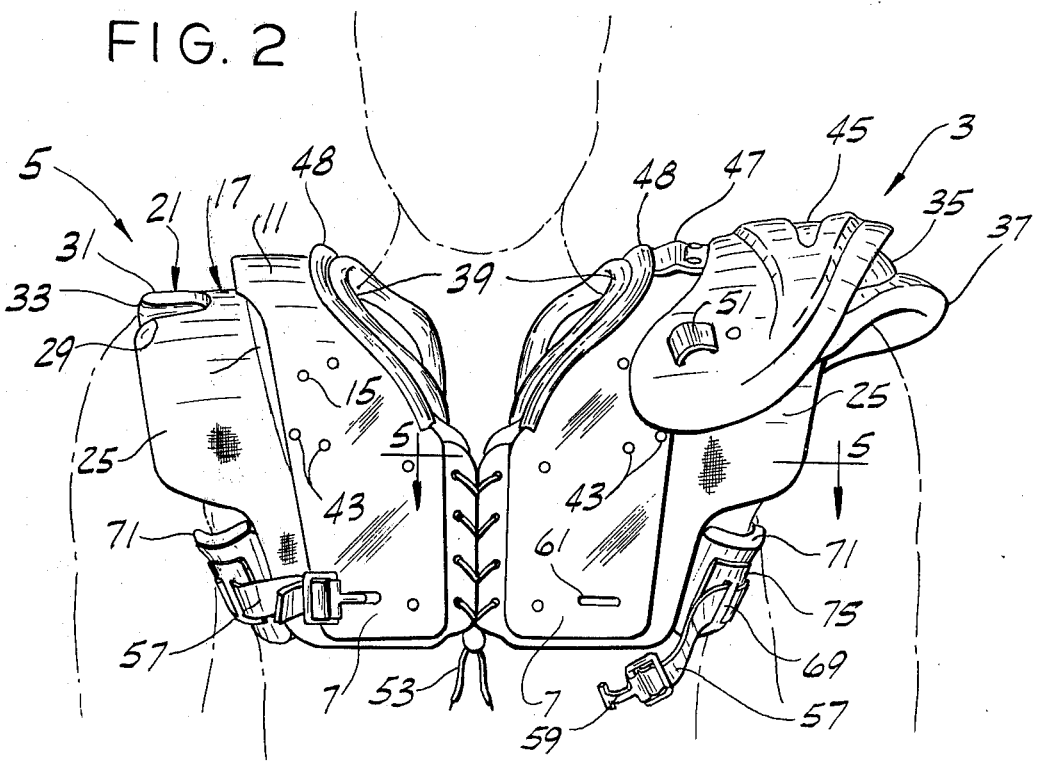
FIG. 2 is a front elevation of FIG. 1 with the flap, the cap, and the shoulder padding of the right-hand member removed.

For added protection, each member 3, 5 has padding generally indicated at 17 secured to the inside thereof as by stitching, which padding 17 preferably comprises a suitable closed-cell elastomeric vinyl foam in a stretch fabric cover. As shown in FIGS. 2 and 4, the padding 17 at the top of arch 11, referred to as arch padding, extends laterally over the shoulder and comprises an inner portion 19 generally beneath the arch overlying the inner part of the shoulder and an outer portion generally indicated at 21 overlying the outer part of the shoulder. The chestplate portion 7, backplate portion 9, and arch 11 of each member and the inner portion 19 of the padding 17 thus protect the body and the inner portion of the shoulder of the wearer, including the sternum, the ribs, the rib cartilages, the clavicle, and the musculature along the midline of the back of the wearer. The outer portion 21 of the arch padding protects the outer part of the shoulder, particularly the pectoral muscles at their point of attachment to the humerous bone, the lateral aspects of the scapula, and the muscles attaching the scapula to the humerous bone.

Figure 3:
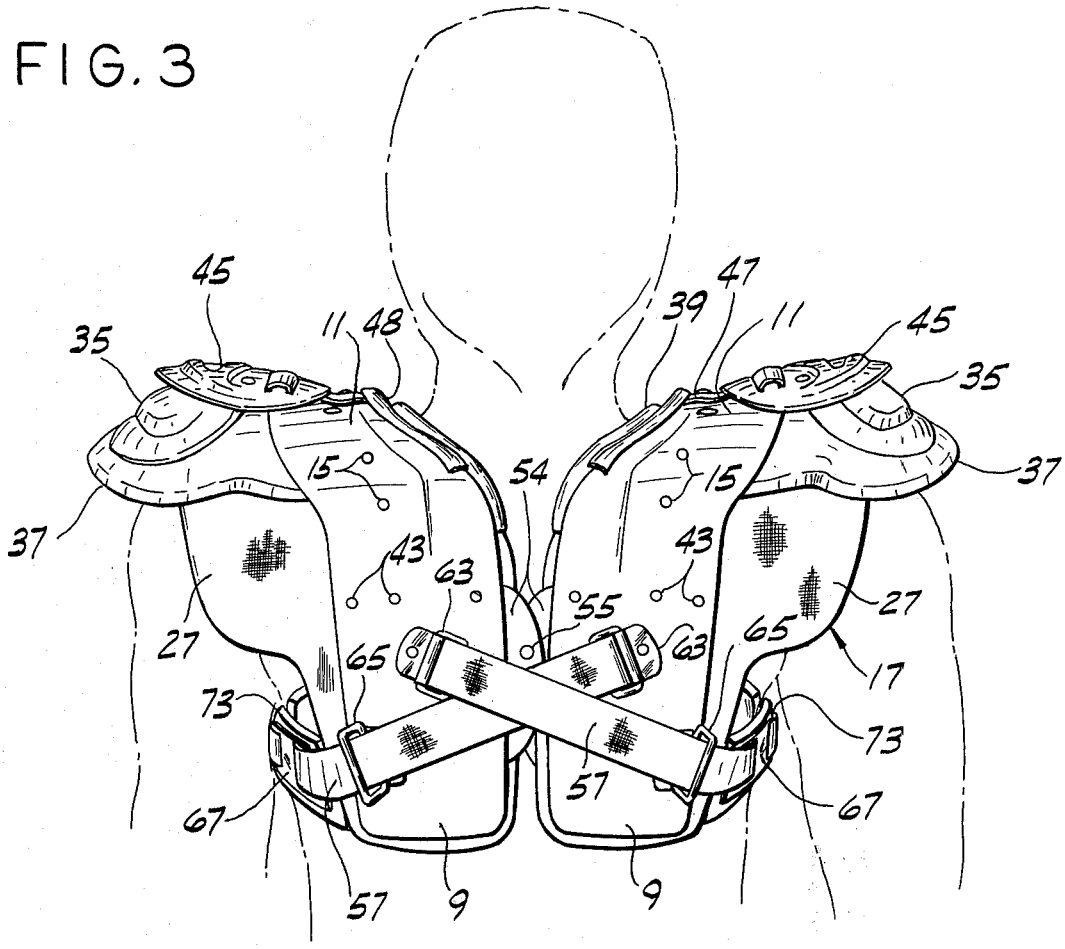
FIG. 3 is a rear elevation of FIG. 1 with the flap of the left-hand member in lowered position.
Figure 4:
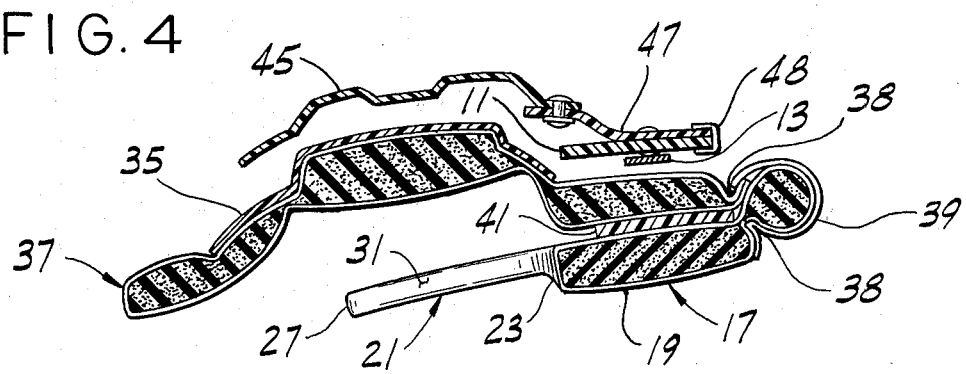
FIG. 4 is an enlarged vertical section on line 4—4 of FIG. 1.
Figure 5:
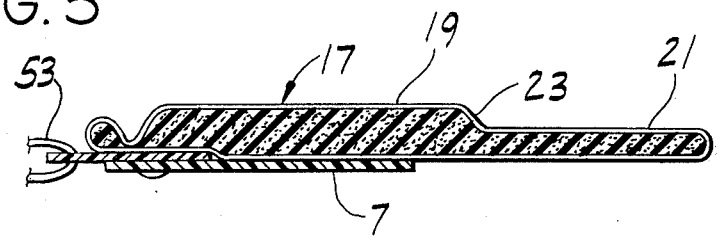
FIG. 5 is an enlarged horizontal section on line 5—5 of FIG. 2.

As best illustrated in FIGS. 4 and 5, the outer portion 21 of the arch padding is thinner than the inner portion 19 and is thus readily swingable upwardly with respect to the inner portion generally about the outer edge 23 of the inner portion. The outer portion 21 of the arch padding is divided into a front section 25 (see FIG. 2) generally adjacent the chestplate portion 7 and a back section 27 (see FIG. 3) generally adjacent the backplate portion 9. These sections 25, 27 are separate toward their outer ends, the front section terminating in a rear edge 29 adjacent the top of the shoulder, and the back section terminating in a forward edge 31 adjacent the top of the shoulder. These edges 29, 31 are spaced apart, forming a recess or slot 33 in the arch padding 17. This slotted construction is advantageous in that it allows the front and back sections 25, 27 of the padding readily to swing upwardly about the outer edge 23 of the inner portion 19 of the arch padding upon upward movement of the arm at the shoulder, and, in addition, allows the sections freely to spread apart (in accordance with their natural tendency) during such movement. Thus, freedom is provided for raising the arms by permitting upward movement of the arms at the shoulders without substantial interference from the padding 17. While the front and back sections 25, 27 of the outer portion of the padding are shown in the drawings to be integrally formed toward their inner ends, it will be understood that these sections may be entirely separate.

The shoulder pad 1 further comprises a pair of caps, each designated 35, of relatively rigid material overlying the outer portions 21 of padding 17 and providing additional protection for the outer part of the shoulders. Caps 35 are convex in shape and have shoulder padding 37 preferably of the same construction as arch padding 17 stitched to the inside thereof. This shoulder padding 37 is separated from arch padding 17 and is hinged thereto along a line of stitching 38 extending along substantially the entire width of the shoulder padding from the front to the back of the shoulder pad and over the shoulder adjacent the inner edge of the arch padding. This construction is advantageous in that it enables the shoulder padding to swing upwardly relative to the arch padding when the arms are raised. Moreover, it provides greater protection for the top of the shoulder and increased resistance to movement of the shoulder padding forward and back across the top of the shoulder as compared to conventional shoulder pads wherein the cap and the shoulder padding are connected to the arch simply by a relatively narrow flexible band. The inner edges of shoulder padding 37 and ach padding 17 are disposed laterally inwardly from arches 11 for holding the arches away from the neck of the wearer. Welted neck padding 39 is provided around the inner edges of the arch and shoulder padding for protecting the neck.

As shown in FIGS. 1 and 4, a strap 41 of relatively pliable material extends from front to back over each shoulder above the inner portion 19 of the arch padding 17. This strip generally corresponds in width to that of the arch and is secured at its ends to the latter by rivets or other suitable permanent fasteners 43. Shoulder padding 37 extends between strip 41 and member 13 laterally outwardly over the outer portion 21 of the arch padding, thereby providing added protection for the top of the shoulder and a snug fit for compactness.

As illustrated in the drawings, a relatively rigid flap 45 of molded plastic overlies each cap 35 and is hinged to a respective arch 11 via a main hinge strap 47. A trim strip 48 is doubled over the inner edge of arch 11 and hinge strap 47. As indicated at 51, a pair of snubber straps connect the flap 45 to the arch 11 at the front and back of the flap for restricting movement of the flap relative to the arch.

The chestplate portions 7 of members 3, 5 are secured together by laces 53 and the backplate portions 9 are connected as shown in FIG. 3. More specifically, the backplate portions 9 are adapted to pivot with respect to one another generally in the plane of the backplate portions about a pin 55 through a pair of overlapping semicircular pivot plates 54 rigidly secured (e.g., riveted) to the backplate portions. The chestplate portions are interconnected to the backplate portions by a pair of adjustable elastic straps 57. These straps are fastened to the chestplate portions by means of T-bars 59 on the ends of the straps receivable in slots 61 in the chestplate portions, and to the backplate portions by means of buckles 63 pivotally mounted on the backplate portions. Each strap 57 extends from the backplate portion 9 of one member 3, 5 through a series of three loops 65, 67, 69 to the chestplate portion 7 of the other member, the first of the loops 65 being on the backplate portion of the latter member and the second and third loops 67, 69 being at a side of the wearer. In this regard, the padding 17 on the inside of the chestplate portion of each member has a side flap 71 extending laterally outwardly and rearwardly from the chestplate portion 7 for covering the front part of a respective side of the wearer, and the padding on the inside of the backplate portion 9 of each member has a side flap 73 extending outwardly and forwardly from the backplate portion for covering the back part of a respective side of the wearer. A relatively small rectangular plate 75 of relatively rigid material is secured to each of the four side flaps 71, 73. Plates 75 have slots therein constituting loops 67 and 69. Thus, with the straps 57 fastened as shown in FIGS. 1 and 3, one of the straps 57 extends from the backplate portion 7 of the left-hand member 3 through the loops 65, 67, 69 of the right-hand member 5 to the chestplate portion of the right-hand member, and the other strap 57 extends from the backplate portion of the right-hand member 5 through the loops 65, 67, 69 of the left-hand member 3 to the chestplate portion of the lefthand member. The straps prevent displacement of the shoulder pad 1 upwardly and otherwise keep the shoulder pad properly positioned on the athlete.

It will be observed from the above that the improved shoulder pad 1 of this invention allows freedom of movement of the upper body, particularly the shoulders, so that the arms may be moved above a horizontal position by permitting upward movement of the arms at the shoulders without substantial interference from arch padding 17 or shoulder padding 37.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A shoulder pad for football players comprising a left-hand member adapted to fit over the left shoulder and a right-hand member adapted to fit over the right shoulder, each of said members being a relatively rigid member of generally inverted U-shape as viewed from the side and having a chestplate portion, a backplate portion and an arch integrally connecting said plate portions, said arches being laterally spaced to provide an opening for the neck of the wearer with the spacing such that said arches lie relatively closely adjacent the neck, each of said members having padding on the inside thereof with the padding at the top of the arch overlying the shoulder, and a pair of caps of relatively rigid material adapted to fit over the outer part of the shoulders and having shoulder padding on the inside thereof separate from said arch padding, the shoulder padding projecting laterally inwardly beyond the caps toward said neck opening, the inner edge of the shoulder padding being hinged to the arch padding via a padding-to-padding hinge connection for enabling the shoulder padding to swing upwardly relative to the arch padding whereby freedom is provided for raising the arms above a horizontal position by permitting upward movement of the arms at the shoulder without substantial interference from the shoulder padding.

2. A shoulder pad as set forth in claim 1 wherein the arch padding on the inside of each arch comprises an inner portion generally beneath the arch adapted to overlie the inner part of a respective shoulder and an outer portion extending laterally outwardly beyond the arch adapted to overlie the outer part of said shoulder, said outer portion comprising a front section adjacent the chestplate portion and a back section adjacent the backplate portion, said front and back sections being separate toward their outer ends for allowing the sections to spread apart upon upward movement of the arm at the shoulder, said shoulder padding overlying said front and back sections of the arch padding at the top of the shoulder and being hinged to the inner portion of the arch padding.

3. A shoulder pad as set forth in claim 2 wherein said front section of the arch padding terminates in a rear edge adjacent the top of the shoulder and said back section terminates in a forward edge adjacent the top of the shoulder, said forward and rear edges being spaced apart to provide a recess therebetween at the outer part of the top of the shoulder extending laterally inwardly to the inner portion of the arch padding, said shoulder padding covering said recess.

4. A shoulder pad as set forth in claim 1 wherein the arch padding has an inner edge spaced laterally inwardly from said arch for holding the arch away from the neck of the wearer, said shoulder padding being hinged to the arch padding adjacent the inner edge of the latter.

5. A shoulder pad as set forth in claim 4 further comprising welted neck padding around the inner edge of said arch padding adjacent the opening for the neck of the wearer.

6. A shoulder pad as set forth in claim 4 wherein the shoulder padding extends from the front to the back of the shoulder pad for overlying the shoulder, and wherein said hinge connection between the shoulder padding and arch padding extends along substantially the entire width of the shoulder padding for providing increased resistance to movement of the shoulder padding forward and back across the top of the shoulder.

7. A shoulder pad as set forth in claim 1 wherein the padding on the inside of the chestplate portion of each member has a side flap extending laterally outwardly and rearwardly from the chestplate portion for covering the front part of a respective side of the wearer, and the padding on the inside of the backplate portion of each member has a side flap extending outwardly and forwardly from the backplate portion for covering the back part of a respective side of the wearer.

8. A shoulder pad as set forth in claim 7 wherein the backplate portions of said left-hand and right-hand members are connected together for relative pivotal movement about a generally horizontal axis extending from the front to the back of the shoulder pad between the backplate portions.

9. A shoulder pad for football players comprising a left-hand member adapted to fit over the left shoulder and a right-hand member adapted to fit over the right shoulder, each of said members being a relatively rigid member of generally inverted U-shape as viewed from the side and having a chestplate portion, a backplate portion and an arch integrally connecting said plate portions, said arches being laterally spaced to provide an opening for the neck of the wearer with the spacing such that said arches lie relatively closely adjacent the neck, each of said members having padding on the inside thereof, the padding at the top of the arch overlying the shoulder, the padding on the inside of the chestplate portion of each member having a side flap extending laterally outwardly and rearwardly from the chestplate portion for covering the front part of a respective side of the wearer, the padding on the inside of the backplate portion of each member having a side flap extending outwardly and forwardly from the backplate portion for covering the back part of a respective side of the wearer, a pair of caps of relatively rigid material adapted to fit over the outer part of the shoulders and having shoulder padding on the inside thereof separate from said arch padding, the shoulder padding being hinged to the arch padding for enabling the shoulder padding to swing upwardly relative to the arch padding whereby freedom is provided for raising the arms above a horizontal position by permitting upward movement of the arms at the shoulder without substantial interference from the shoulder padding, means for interconnecting the backplate and chestplate portions comprising loops on said side flaps and on the backplate portions, a pair of elastic straps adapted to pass through said loops, and means on each of the backplate and chestplate portions for fastening the ends of said straps thereto, one of said straps extending from the fastening means on the backplate portion of the left-hand member to the fastening means on the chestplate portion of the right-hand member through the loops on the side flaps and the backplate portion of the right-hand member, and the other of said straps extending from the fastening means on the backplate portion of the right-hand member to the fastening means on the chestplate portion of the left-hand member through the loops on the side flaps and the backplate portion of the left-hand member.

10. A shoulder pad for football players comprising a left-hand member adapted to fit over the left shoulder and a right-hand member adapted to fit over the right shoulder, each of said members being a relatively rigid member of generally inverted U-shape as viewed from the side and having a chestplate portion, a backplate portion and an arch integrally connecting said plate portions, said arches being laterally spaced to provide an opening for the neck of the wearer with the spacing such that said arches lie relatively closely adjacent the neck, each of said members having padding on the inside thereof with the padding at the top of the arch overlying the shoulder, the arch padding on the inside of each arch comprising an inner portion generally beneath the arch adapted to overlie the inner part of a respective shoulder and an outer portion extending laterally outwardly beyond the arch adapted to overlie the outer part of said shoulder, said outer portion comprising a front section adjacent the chestplate portion and a back section adjacent the backplate portion, said front and back sections being separate toward their outer ends for allowing the sections to spread apart upon upward movement of the arm at the shoulder with the said outer portion of the arch padding being thinner than the inner portion and swingable upwardly with respect to the inner portion on upward movement of the outer part of the shoulder, and a pair of caps of relatively rigid material adapted to fit over the outer part of the shoulders and having shoulder padding on the inside thereof separate from said arch padding and overlying said front and back sections of the arch padding at the top of the shoulder, the shoulder padding being hinged to the arch padding for enabling the shoulder padding to swing upwardly relative to the arch padding whereby freedom is provided for raising the arms above a horizontal position by permitting upward movement of the arms at the shoulder without substantial interference from the shoulder padding.

* * * * *

UNITED STATES PATENT AND TRADEMARK OFFICE

CERTIFICATE OF CORRECTION

PATENT NO. : 4,320,537

DATED : March 23, 1982

INVENTOR(S) : Hal D. Mitchell

It is certified that error appears in the above—identified patent and that said Letters Patent is hereby corrected as shown below:

Column 3, line 17, "separated" should read -- separate --; line 18, after "38" the phrase -- (constituting a padding-to-padding hinge connection)-- should be inserted.

Signed and Sealed this

*Twelfth* Day of *October 1982*

[SEAL]

*Attest:*

GERALD J. MOSSINGHOFF

*Attesting Officer*

*Commissioner of Patents and Trademarks*